US005305475A

United States Patent [19]

Jaeckels et al.

[11] Patent Number: 5,305,475

[45] Date of Patent: Apr. 26, 1994

[54] PUMP OPERATED PLUMBING FIXTURE

[75] Inventors: Norman J. Jaeckels, Sheboygan; John A. Fiumefreddo, Plymouth; Michael P. Gray, Kohler; Anton J. Kolar; Randy O. Mesun, both of Sheboygan; Jeffrey F. Tempas, Oostburg, all of Wis.

[73] Assignee: Kohler Co., Kohler, Wis.

[21] Appl. No.: 976,109

[22] Filed: Nov. 13, 1992

[51] Int. Cl.[5] ..... E03D 1/14; E03D 1/28; E03D 5/01; E03D 11/02

[52] U.S. Cl. ..... 4/325; 4/329; 4/345; 4/353; 4/427

[58] Field of Search ..... 4/300, 324, 325, 329, 4/330, 331, 332, 345, 353, 415, 421, 422, 423, 427, 432

[56] References Cited

U.S. PATENT DOCUMENTS

| | | | |
|---|---|---|---|
| 1,205,078 | 11/1916 | Barron | 4/427 |
| 1,625,950 | 4/1927 | Lee | 4/432 |
| 2,658,203 | 11/1953 | Aue | 4/332 |
| 2,979,731 | 4/1961 | Reetz | 4/432 |
| 3,035,274 | 5/1962 | Baughman | 4/432 |
| 3,431,563 | 3/1969 | Rascov | 4/432 X |
| 3,582,995 | 8/1971 | Enenstein | 4/664 |
| 3,858,249 | 1/1975 | Howard | 4/345 X |
| 3,908,204 | 9/1975 | Hopkins | 4/406 |
| 3,918,105 | 11/1975 | Young | 4/326 |
| 3,932,901 | 1/1976 | Inui et al. | 4/332 |
| 3,986,216 | 10/1976 | Davis et al. | 4/432 |
| 4,041,557 | 8/1977 | Ringler | 4/427 |
| 4,152,794 | 5/1979 | Pan | 4/432 |
| 4,183,105 | 1/1980 | Womack | 4/300 |
| 4,392,260 | 7/1983 | Bensen | 4/324 |
| 4,408,361 | 10/1983 | Rozek | 4/331 |
| 4,439,874 | 4/1984 | Schrock | 4/332 X |
| 4,742,583 | 5/1988 | Yoshida et al. | 4/313 |
| 4,918,763 | 4/1990 | Brotcke | 4/331 |
| 5,010,602 | 4/1991 | Sargent et al. | 4/432 |
| 5,036,553 | 8/1991 | Sanderson | 4/313 |
| 5,073,994 | 12/1991 | Sargent et al. | 4/332 |
| 5,109,550 | 5/1992 | Makita et al. | 4/300 |
| 5,123,124 | 6/1992 | Brower | 4/324 X |
| 5,133,089 | 7/1992 | Tsutsui et al. | 4/300 |

*Primary Examiner*—Robert M. Fetsuga
*Attorney, Agent, or Firm*—Quarles & Brady

[57] ABSTRACT

A toilet has a pump to deliver selected quantities of water from a reservoir to a toilet bowl so as to effect a water savings. In one aspect, both the motor and pump are positioned in the reservoir to deliver water to both the rim and bowl portions. In another aspect, there are conduits connected between the basin, the rim and controls which are provided to deliver water to the rim and bowl either independently, simultaneously or in selective sequences. In alternative embodiments, a refill tube is connected to an intake conduit and the rim of the bowl to effect a water seal, a fail safe valve is connected to the supply conduit, a receptacle with a cleaning fluid and a pump is connected to the bowl and there are at least two receptacles for receiving waste.

26 Claims, 13 Drawing Sheets

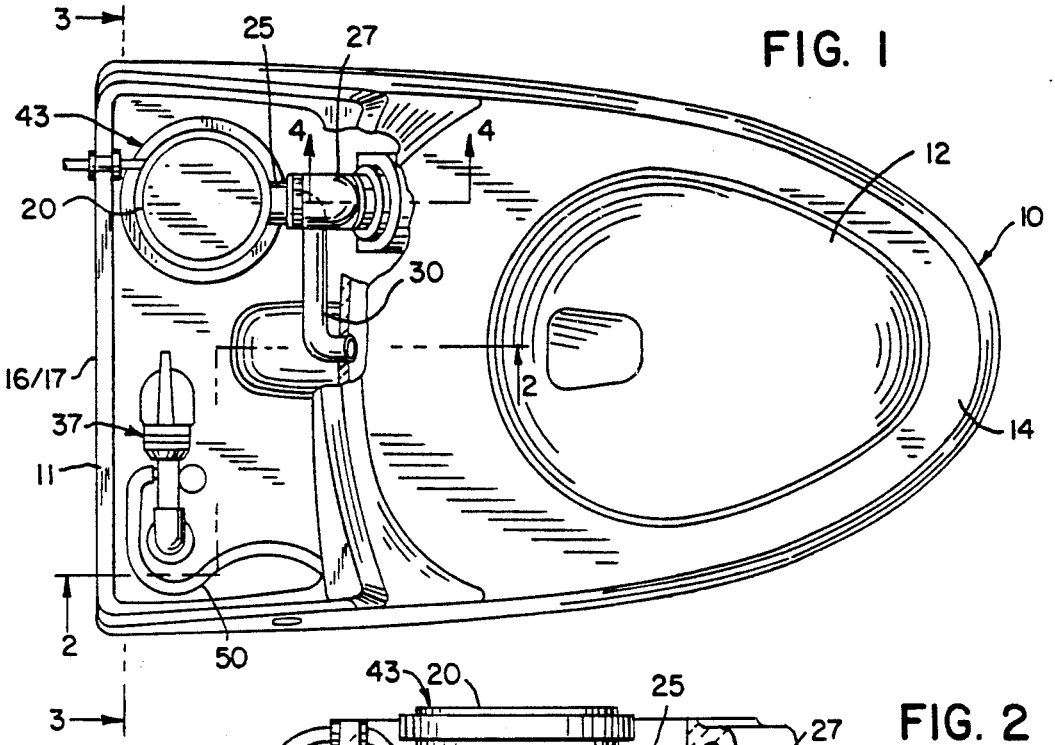
FIG. 1
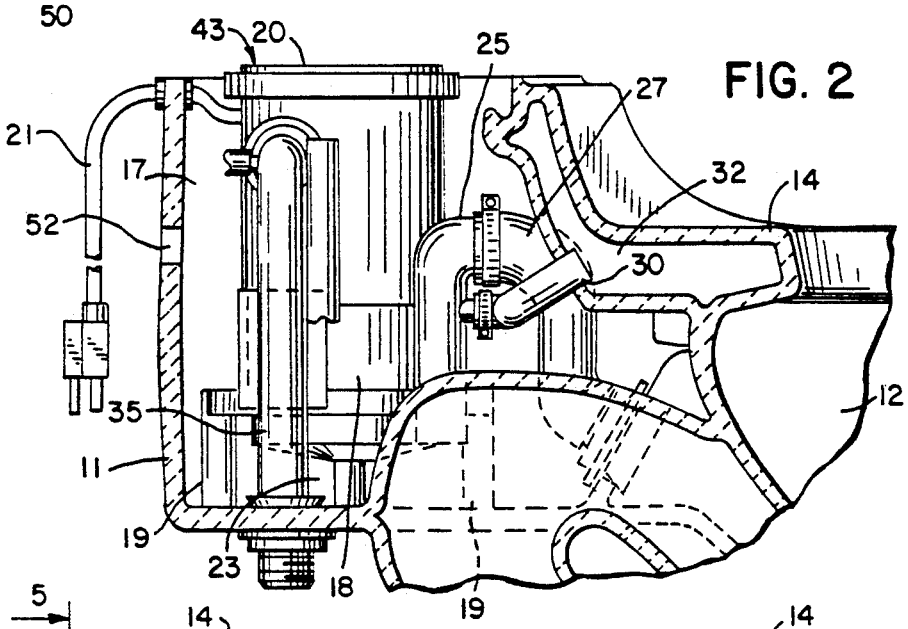
FIG. 2
FIG. 4
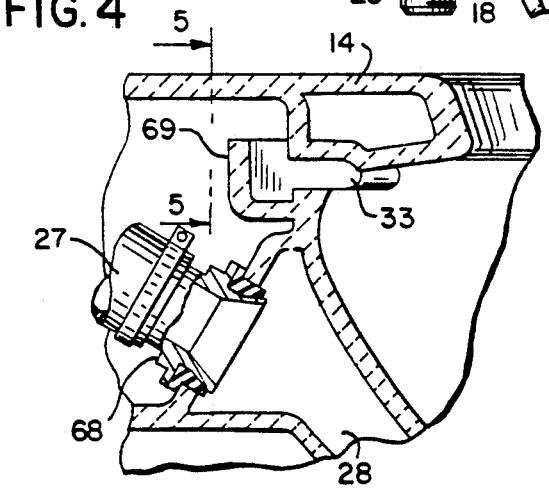
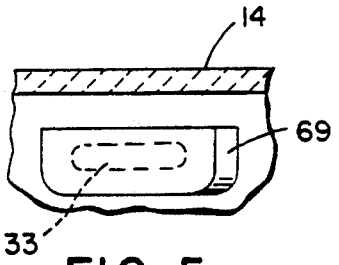
FIG. 5

FIG. 3
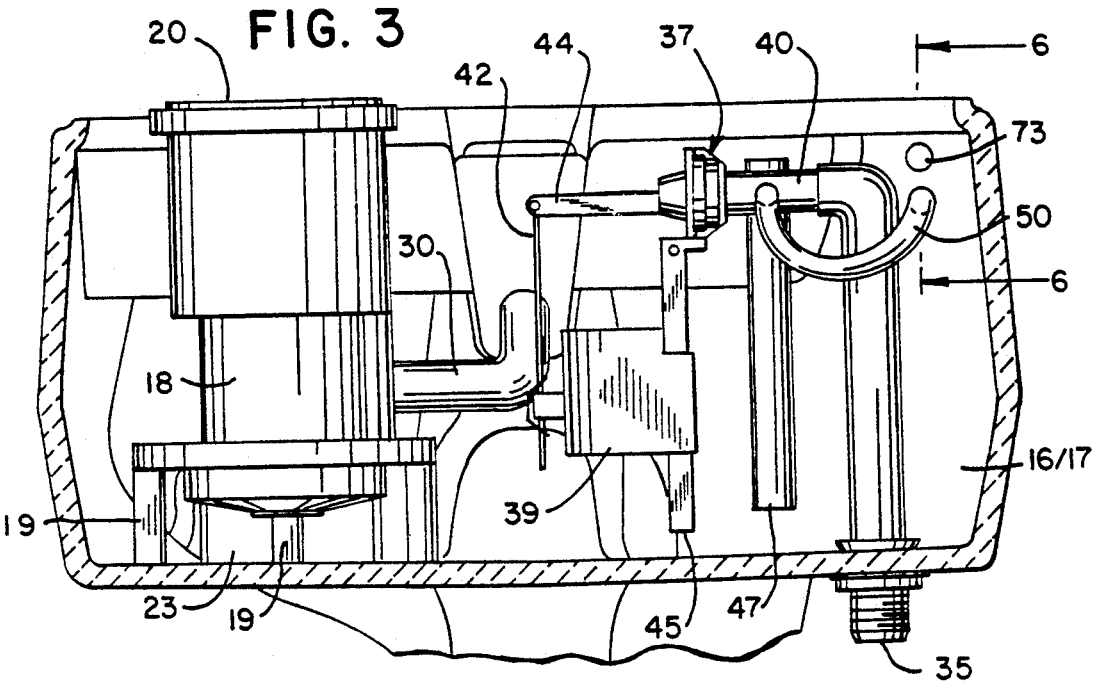
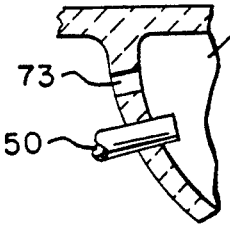
FIG. 6
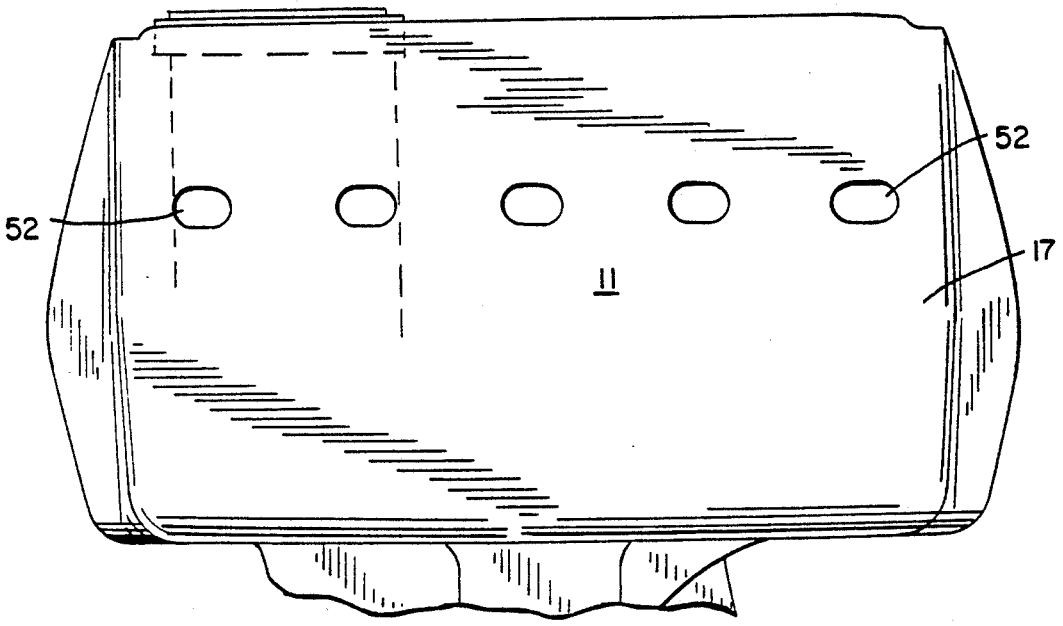
FIG. 7

FIG. 10
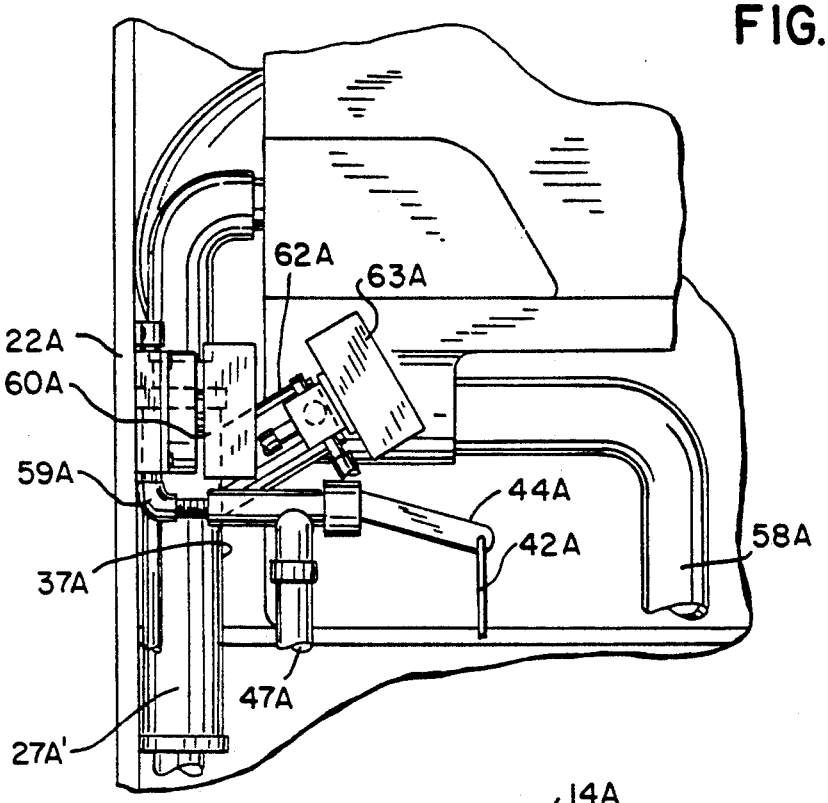
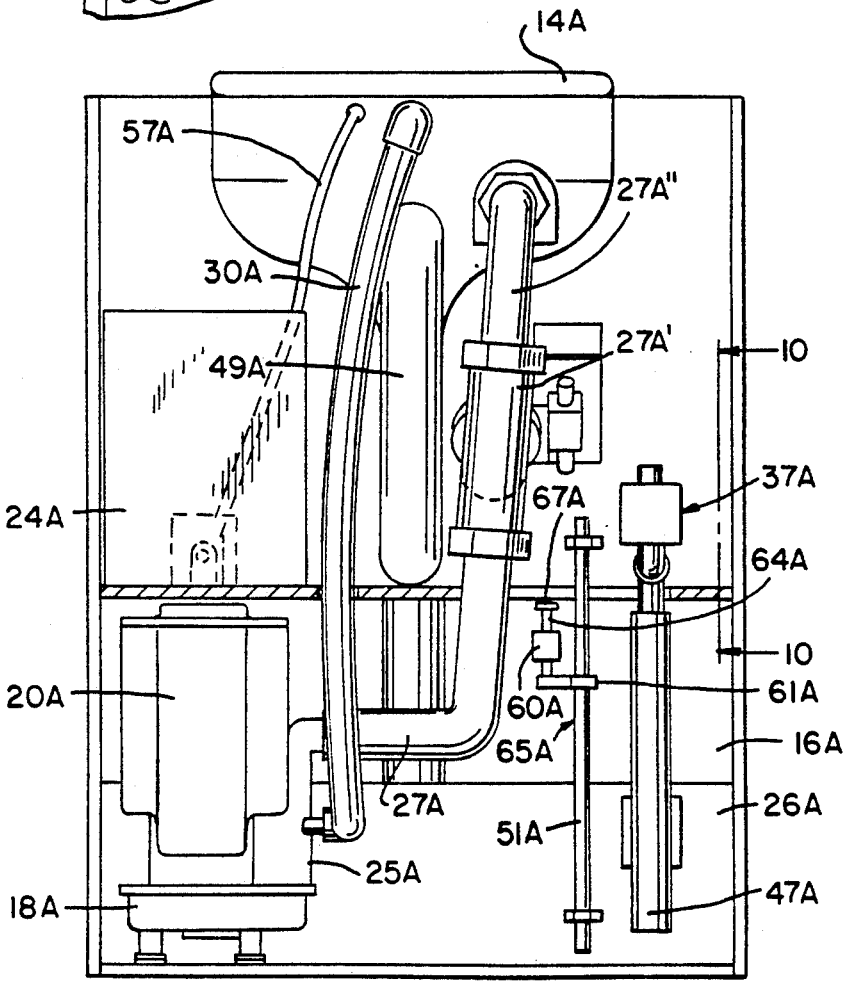
FIG.9

FIG. 12
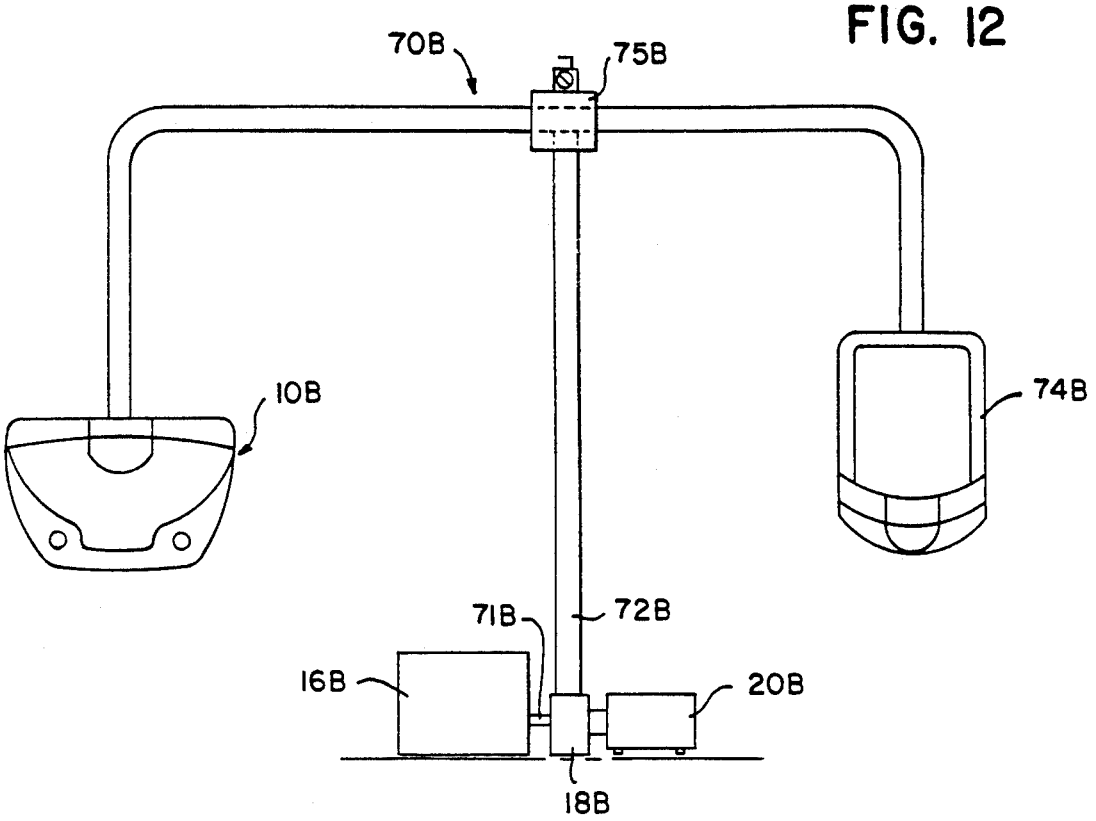
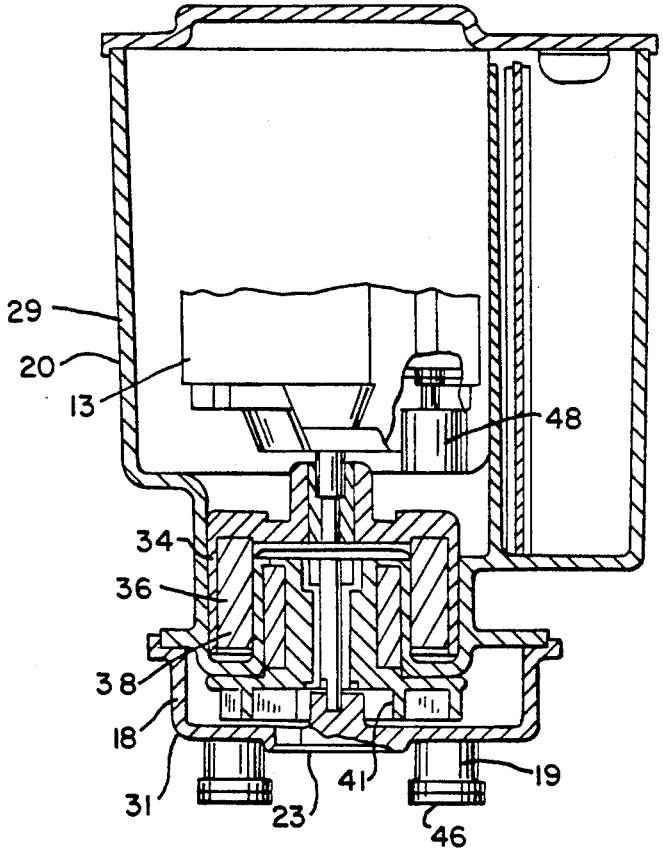
FIG. 13

A
FROM FIG. 15A
97
LONG KEY PRESSED OR LID SHUT ?
N
Y
105
SHORT KEY PRESSED ?
N
Y
98
VALID INPUT ?
N
Y
106
VALID INPUT ?
N
99
TURN ON MAIN PUMP
107
TURN ON MAIN PUMP
DELAY 3.17 SEC
MOTOR SPEED
MOTOR SPEED
DELAY 2.07 SEC
108
100
101
TURN OFF MAIN PUMP
102
ADD 60 SEC TO FLUSH TIMER
103
LONG KEY PRESSED OR LID SHUT ?
Y
N
104
SHORT KEY PRESSED ?
Y
N
TO FIG. 15A
B

A
FROM FIG. 16A
TOILET FLUSH KEY PRESSED ?
110
Y
N
URINAL FLUSH KEY PRESSED ?
118
Y
N
SEAT FLUSH INPUT ACTIVE ?
112
Y
N
VALID INPUT ?
106
N
Y
TURN ON MAIN PUMP
107
DELAY 2.5 SEC
108
VALID INPUT ?
98
N
Y
TURN ON MAIN PUMP
99
DELAY 3.5 SEC
100
TURN OFF MAIN PUMP
101
ADD 60 SEC TO FLUSH TIMER
102
TOILET FLUSH KEY PRESSED ?
116
Y
N
URINAL FLUSH KEY PRESSED ?
117
Y
N
TO FIG. 16A
B

PUMP OPERATED PLUMBING FIXTURE

BACKGROUND OF THE INVENTION

This invention relates to water saving plumbing fixtures. More particularly, it relates to improved means for using a pump to assist in the operation of plumbing fixtures such as toilets and urinals.

DISCUSSION OF THE PRIOR ART

Gravity feed toilets of the type having a reservoir at least partially above the level of a toilet bowl have in the past typically had a water capacity of 3 or more gallons for flushing the toilet. In recent years the efficiency of these toilets have been improved such that in many cases 1.6 gallons of water is sufficient to clean the bowl. However, where especially large amounts of feces are present double flushing may still be needed to completely clean the bowl. Moreover, it was hoped that additional water savings could be effected if these toilets could be made even more efficient during normal flushes and if less water could be employed to flush when only urine and toilet tissue are in the bowl.

One known way to reduce the amount of water needed to effect flushing is to pressurize the flush water. See U.S. Pat. Nos. 2,979,731, 3,431,563 and 5,036,553. However, these prior systems were complex, costly and usually not suitable to completely fit in standard size toilets. They also suffered from other problems.

Thus a need exists for an improved pump operated plumbing fixture which alters the amount of water used based on the type of material to be flushed, more efficiently sequences the flush water with respect to the rim portion and the bowl portion, permits water distribution to multiple fixtures from a single reservoir, permits alternative placement of the reservoir, permits an aesthetically pleasing compact design, resolves potential water overflow problems, meets safety standards relating to electrical shorting, and has good bowl cleaning and waste evacuation characteristics

SUMMARY OF THE INVENTION

In one aspect, the invention provides a plumbing fixture for receiving flushable waste comprising at least one receptacle for receiving the waste, a reservoir tank for storing a volume of flush water, a pump motor and pump (both positioned in the reservoir tank), the inlet of the pump being in communication with the interior of the reservoir tank, a conduit connected between a pump outlet and the receptacle, and control means selectively and operatively connected to the motor to operate the pump for one period of time to deliver a quantity of flush water to the pump outlet.

In another preferred form, the pump means is positioned either inside or outside the reservoir tank and the control means is selectively and operatively connected to the motor to the pump means to operate the pump for at least one other period of time to deliver at least one other quantity of flush water to the receptacle.

In still another preferred form, there are at least two receptacles for receiving waste such as a toilet and an urinal.

In still another aspect, a refill valve is operatively connected to an intake conduit, and a tube is connected between the refill valve and the rim of a toilet bowl.

In still another preferred form, there are control means which include a time delay means to prevent activation of the pump and overflow of the toilet bowl.

In another aspect, there is a fluid passage means disposed through the tank wall and positioned below the motor and electrical connection to the motor.

In yet another aspect, there is a receptacle for storing a fluid such as a cleaning fluid and an additional pump means for pumping such a fluid into the toilet bowl to clean the toilet bowl.

In yet another aspect, there are overflow prevention means for both the reservoir tank and the toilet bowl. Concerning the reservoir tank, an electrically operated fail-safe valve is connected to the supply conduit to shut off the water supply in the instance where there is a leaky supply valve. There is also an overflow sensor connected to a pump motor to pump excess water from the tank. Concerning the toilet bowl, there is a time delay feature to prevent excessive operation of the pump and flooding of the toilet bowl.

In yet another preferred form, there are first and second conduits connected between the pump outlet and the basin and the rim. Control means connected to the motor and pump sequentially delivers a volume of flush water to the rim, a volume of flush water to the bowl either alternatively, or simultaneously, and in selective sequences.

The objects of the invention therefore include:

a. providing a plumbing fixture of the above kind wherein reduced quantities of water can be employed to remove flushable waste from a toilet bowl or a urinal.

b. providing a plumbing fixture of the above kind wherein a pump and motor can be electrically controlled to deliver different quantities of water and in different timing sequences to a toilet bowl and rim.

c. providing a plumbing fixture of the above kind wherein safeguards are provided to substantially reduce the possibility of overflow conditions.

d. providing a plumbing fixture of the above kind wherein the pump can be easily connected or disconnected to a plumbing fixture.

e. providing a plumbing fixture of the above kind wherein one pump can service a multiplicity of plumbing fixtures.

f. providing a plumbing fixture of the above kind wherein a constant, predetermined volume and flow of water is delivered to the jet channel regardless of supply line pressure or flow characteristics.

g. providing a plumbing fixture of the above kind wherein a cleaning fluid can be pumped from a separate tank to the toilet bowl for cleaning purposes.

h. providing a plumbing fixture of the above kind which can be fitted to standard water supply and waste lines.

i. providing a plumbing fixture of the above kind wherein the pump and the reservoir are positioned remote from a toilet bowl or urinal.

j. providing a plumbing fixture of the above kind wherein flush activation is effected by switches.

These and still other objects and advantages of the invention will be apparent from the description which follows. In the detailed description below, preferred embodiments of the invention will be described in reference to the accompanying drawings. These embodiments do not represent the full scope of the invention. Rather the invention may be employed in other embodiments. Reference should therefore be made to the claims herein for interpreting the breadth of the invention.

BRIEF DESCRIPTION OF THE DRAWINGS

FIG. 1 is a top plan, partially fragmentary view of a toilet (with tank lid removed) in which a preferred embodiment of the invention is mounted.

FIG. 2 is a partial sectional view taken along line 2—2 of FIG. 1.

FIG. 3 is a sectional view taken along line 3—3 of FIG. 1.

FIG. 4 is partial sectional view taken along line 4—4 of FIG. 1.

FIG. 5 is a partial sectional view taken along line 5—5 of FIG. 4.

FIG. 6 is a partial sectional view taken along line 6—6 of FIG. 3.

FIG. 7 is a rear elevational view of the toilet shown in FIG. 1.

FIG. 9 is a rear elevational view in partial section of the toilet shown in FIG. 8.

FIG. 10 is a sectional view taken on line 10—10 of FIG. 9.

FIG. 12 is a diagrammatic view of yet another embodiment.

FIG. 13 is a view in vertical section illustrating in more detail a pump and motor for use in the toilets described herein.

DETAILED DESCRIPTION OF THE PREFERRED EMBODIMENTS

Figure 8:
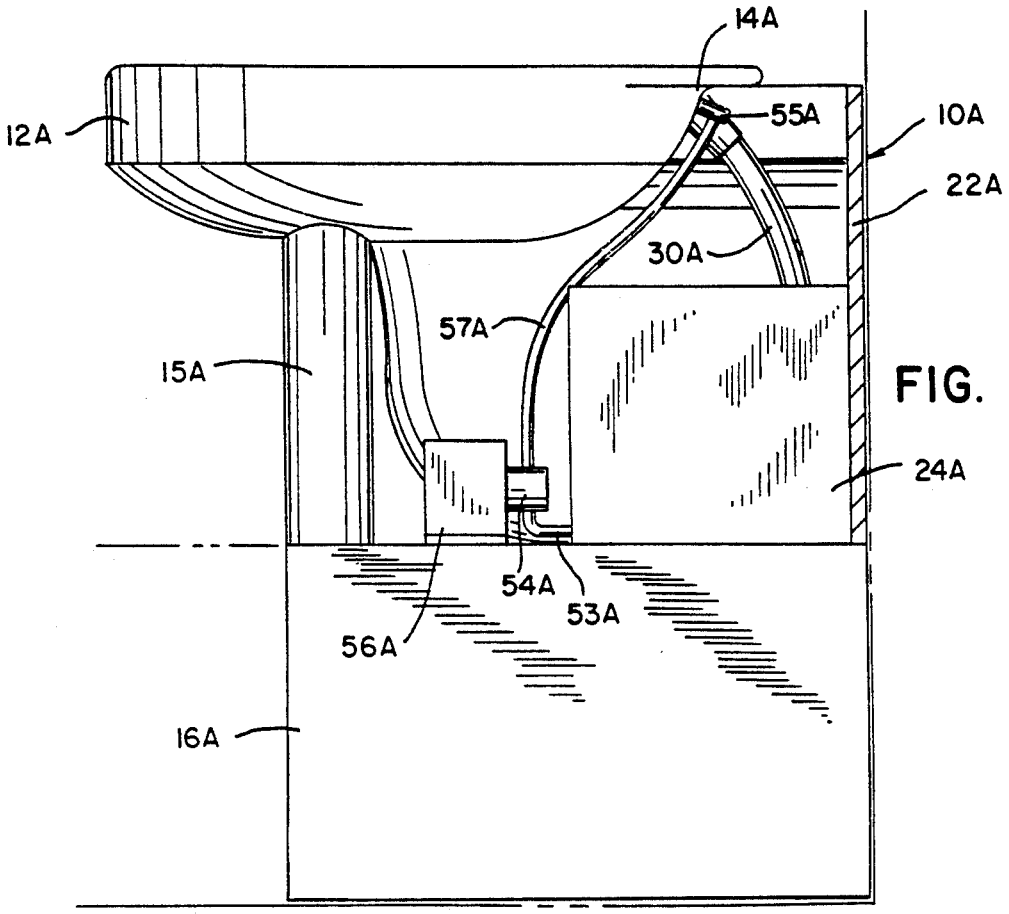
FIG. 8 is a view in side elevation and partially in section illustrating an alternative embodiment.

Referring to FIGS. 1 and 2, there is shown a toilet generally 10 having a basin or bowl portion 12 with a hollow rim 14. A "reservoir" 16 is in the form of tank 17. Positioned in the tank 17 is a pump 18 which is of the sump type. It is supported in the reservoir by vibration absorbing feet 19. Pump unit generally 43 includes a pump 18 driven by an electric motor 20 with electric power being supplied by electrical cord 21. The motor 20 drives the pump 18 by means of a sealed and enclosed magnetic drive which is explained below in more detail in conjunction with FIG. 13. It should be noted that one surprising aspect of the invention is positioning an electrical motor in the toilet water tank.

Water enters the pump 18 at inlet 23 and exits the pump 18 by the outlet manifold 25. An outlet conduit 27 delivers water to the lower portion of bowl 12, such as through jet channel 28 (See FIG. 4) attached via connector 68. A smaller conduit 30 delivers water to the rim 14 through the channel 32.

Referring to FIGS. 2 and 3, water enters the tank 17 by the inlet pipe 35 which is connected to a conventional water source. A float valve assembly 37 includes a float 39 which operates a valve (not shown) in pipe 40 by means of rod 42 and lever arm 44. Float 39 is guided by the guide member 45. Water that passes the inlet valve enters the reservoir through the inlet valve hush tube 47. There is also a bypass tube 50 connected to the float valve assembly to deliver a small amount of water to the rim 14 whenever the float valve is in an open condition.

As best seen in FIGS. 4 and 5, there is a return passage 33 between the upper bowl portion 12 and the reservoir 16. This allows for water to pass from the tank to the bowl in case there is an overflow condition in the tank. It also permits flow in the other direction if there is a stoppage in the bowl and a near over flow condition develops.

There is also a dam member 69 which is positioned adjacent the return passage 33 and inside the tank 17. This serves to raise the water level in the tank 17 or the bowl portion 12 before overflowing into the other occurs. A rim vent hole 73 is also provided to facilitate water flow, as best shown in FIGS. 3 and 6.

Referring now to FIG. 7, there are several openings 52 extending through the back wall 11 of the tank 17. The purpose of the openings 52 is that if return passage 33 is blocked to allow overflow water from tank 17 to spill out of the tank. The openings 52 provide a fluid spill passage and are positioned in the tank a distance above the bottom so that overflow water will escape prior to contact with the electrical connection from cord 21 with the motor 20 and are positioned below the point where water could enter the motor. The position of this connection is indicated in FIG. 2. The openings 52 also prevent contaminated water from rising high enough in the tank to contact intake water in pipe 40.

FIGS. 8–11 represent alternative embodiments generally 10A. The same or similar components are designated with the same reference numerals as for the first embodiment except followed by the letter "A". One of the differences between the two embodiments is the placement of the reservoir 16A below the bowl portion 12A and accordingly the water level in the reservoir 16A below that of the bowl portion 12A. A support post 15A for the bowl portion 12A is provided as well as a surrounding housing 22A extending along the sides and back of the bowl portion 12A.

In the FIG. 8 version, positioned on the reservoir 16A is a receptacle 24A which contains a cleaning fluid for cleansing the bowl portion 12A. The cleaning fluid is pumped from the receptacle 24A by means of the conduit 53A connected to the inlet side of the pump 54A driven by the motor 56A. A second conduit 57A extends from the outlet side of the pump 54A to the rim 14A of the bowl portion 12A where it is connected to inlet tube 55A.

Figure 11:
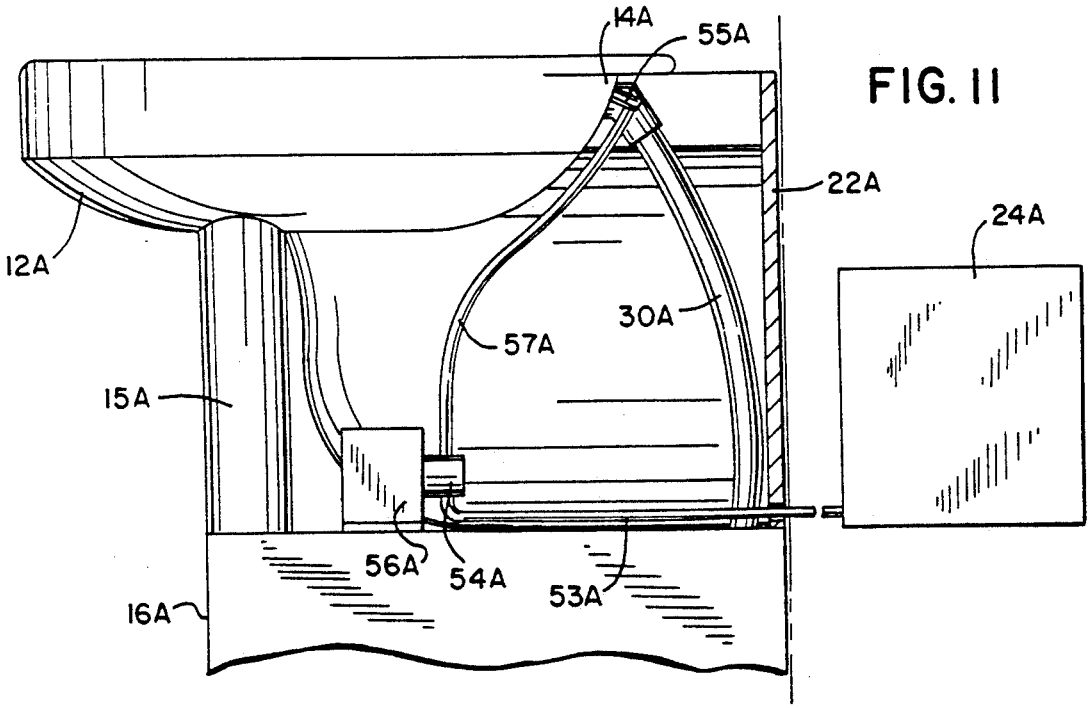
FIG. 11 is a view similar to FIG. 8 showing still another alternative embodiment.

FIG. 11 shows an alternative placement of the receptacle 24A outside of the surrounding housing 22A.

FIGS. 9 and 10 particularly illustrate the supply of water to the reservoir 16A, as well as to the rim 14A and bowl portion 12A. The pump 18A and motor 20A are located in the reservoir 16A. Water enters through the float valve assembly 37A and is delivered to the reservoir 16A by the outlet pipe 47A. However, in this instance, inlet water is supplied to the float valve assembly 37A by the supply line 59A. The inlet water is supplied through the back of housing 22A through line 59A and is controlled by a normally closed solenoid which opens, when electrically activated, the valve 60A. Pump 18A supplies water to the bowl portion 12A by means of the conduit 27A which is connected to conduits 27A' and 27A" as well as to manifold 25A. It also supplies water to the rim 14A by the conduit 30A connected to the manifold 25A.

As best seen in FIG. 10, there is a solenoid diaphragm valve 62A connected to conduit 27A'. It is operated by a pilot 63A and is maintained in a closed position until activated to supply water to the bowl portion 12A.

Referring specifically to FIG. 9, there is shown a water level sensor device generally 65A which includes a float 66A mounted on guide rod 64A having an electrical contact cap 67A on the end thereof. Contact by the float 66A with the cap 67A will send an electrical signal to motor 20A to operate pump 18A and thereby determine the maximum level of water 26A in reservoir 16A. Guide rod 64A is supported on bracket 61A which in turn is adjustably connected to support rod 51A. A trapway 49A communicating with the typical outlet drain 58A is also shown.

FIG. 12 illustrates yet another alternative embodiment (generally 70B). The same or similar components are designated with the same reference numerals as for the first embodiment, except followed by the letter "B". In this embodiment 70B, the pump 18B and the motor 20B are located outside of a plumbing fixture such as a wall hung toilet 10B. In this instance, flush water would be contained in reservoir 16B and is pumped from the reservoir 16B by means of the intake conduit 71B and the output conduit 72B. Water is diverted to the toilet 10B and/or the urinal 74B through the diverter valve 75B.

In a preferred manner, the volume of water pumped to the toilet 10B will be 1.6 gallons or less, whereas that normally delivered to the urinal 74B would be 1.0 gallon or less. The volume of water delivered to the toilet 10B and the urinal 74B can be controlled by a timing circuit as is explained later in conjunction with FIGS. 14 and 16A and B.

FIG. 13 shows in more detail a pump 18 which is driven by the motor 20. Both the motor 20 and the pump 18 are enclosed in sealed housings 29 and 31. An electric motor 13 drives rotor 34 having magnets 36 which attract magnets 38 carried by the pump rotor 41. This effects a pumping action causing water to enter at entrance 23 and to exit from manifold 25 (See FIG. 2). It should be noted that placement of the magnets 36 and 38 in their respective plastic housings effects a seal between the rotors 34 and 41, thus reducing the chance of an electrical short into the reservoir water. Footmembers 46 provide for suitable spacing of entrance 23 from the bottom of reservoir 16 or 16A (See FIG. 2 or FIG. 3). A support member 48 positions the electric motor 13 at a predetermined distance above the floor of motor housing 29.

FIGS. 14–17C illustrate electrical controls for the previously described embodiments. A microprocessor 80 is programmed to effect the desired and described functions which in the instance of embodiment 10A include a short flush function, a long flush function (which can be activated by the seat cover being closed), as well as a special bowl cleaner flush. These functions can be initiated by the respective switch buttons 81, 82 and 83 which preferably are of the touch type. A switch of this kind would be a membrane switch which would have a long flush and a short flush function in the same switch housing. In the instance of the seat cover closed function, it has in addition to activating switch 84, a monostable multivibrator 85 which is commonly known as a "one-shot".

This particular seat cover closed function is described in more detail in commonly owned U.S. patent application Ser. No. 07/824,808 filed Jan. 22, 1992 which teachings are incorporated herein by reference. See also U.S. Pat. No. 3,590,397. Basically the idea is that the position of a magnet for the bowl lid is sensed by a sensor in the tank and the information leads to control of flushing (e.g. when the lid is first closed, a flush occurs). The level sensor 65A is also inputted to the microprocessor 80. The output side of the microprocessor 80 is connected to the main pump 18A, the pump 54A for the toilet bowl cleanser liquid, and the supply valve solenoid 62A by the lines 86, 87 and 88, respectively. As explained later, in conjunction with embodiment 70B, the short flush button 81 will represent the function of the urinal flush key being pressed as shown at 118 in FIG. 16B.

Figure 15A:
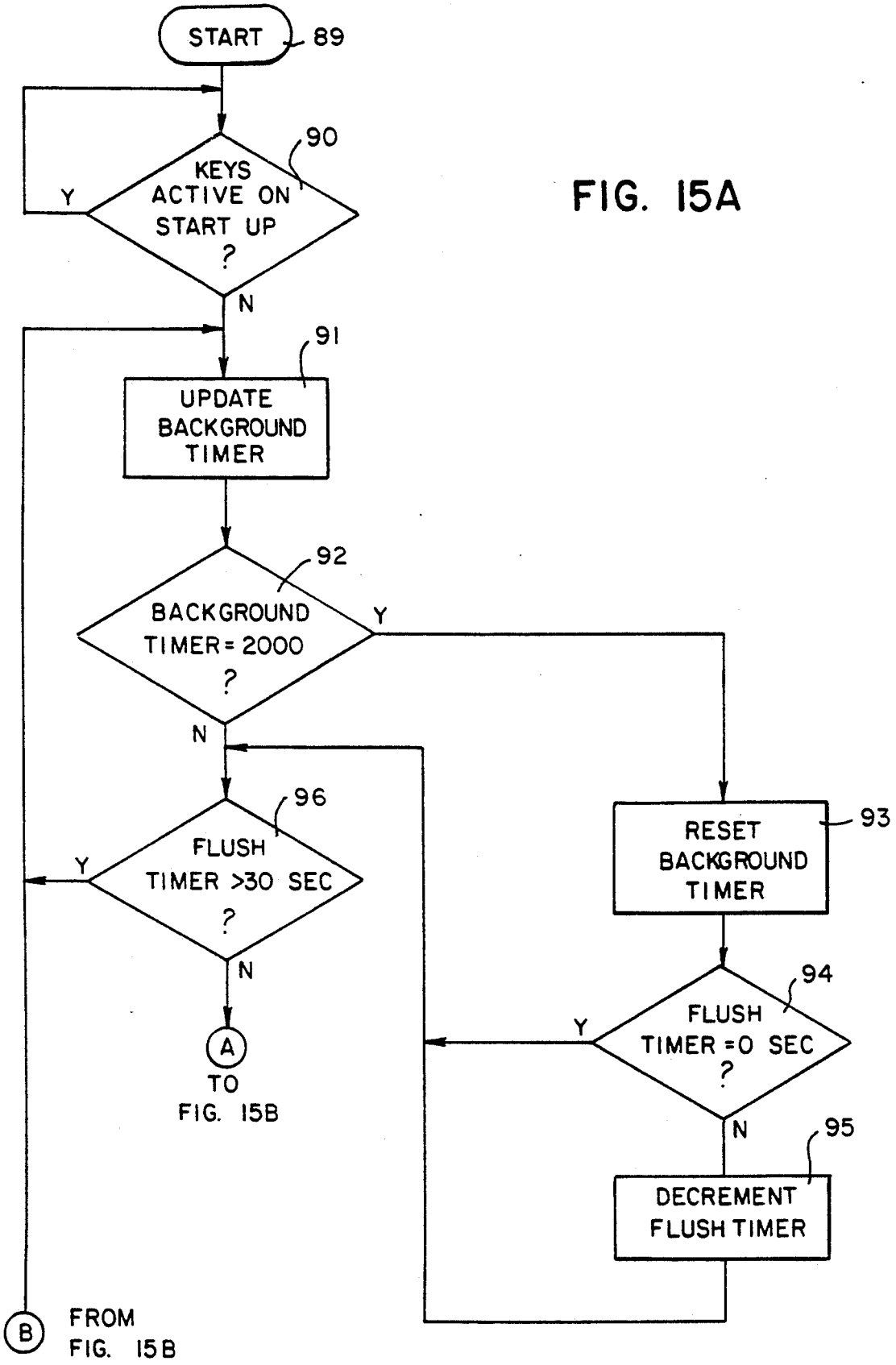
FIGS. 15A–17C are flow charts showing a signal flow block diagram for the control circuit shown in FIG. 14.
Figure 15B:
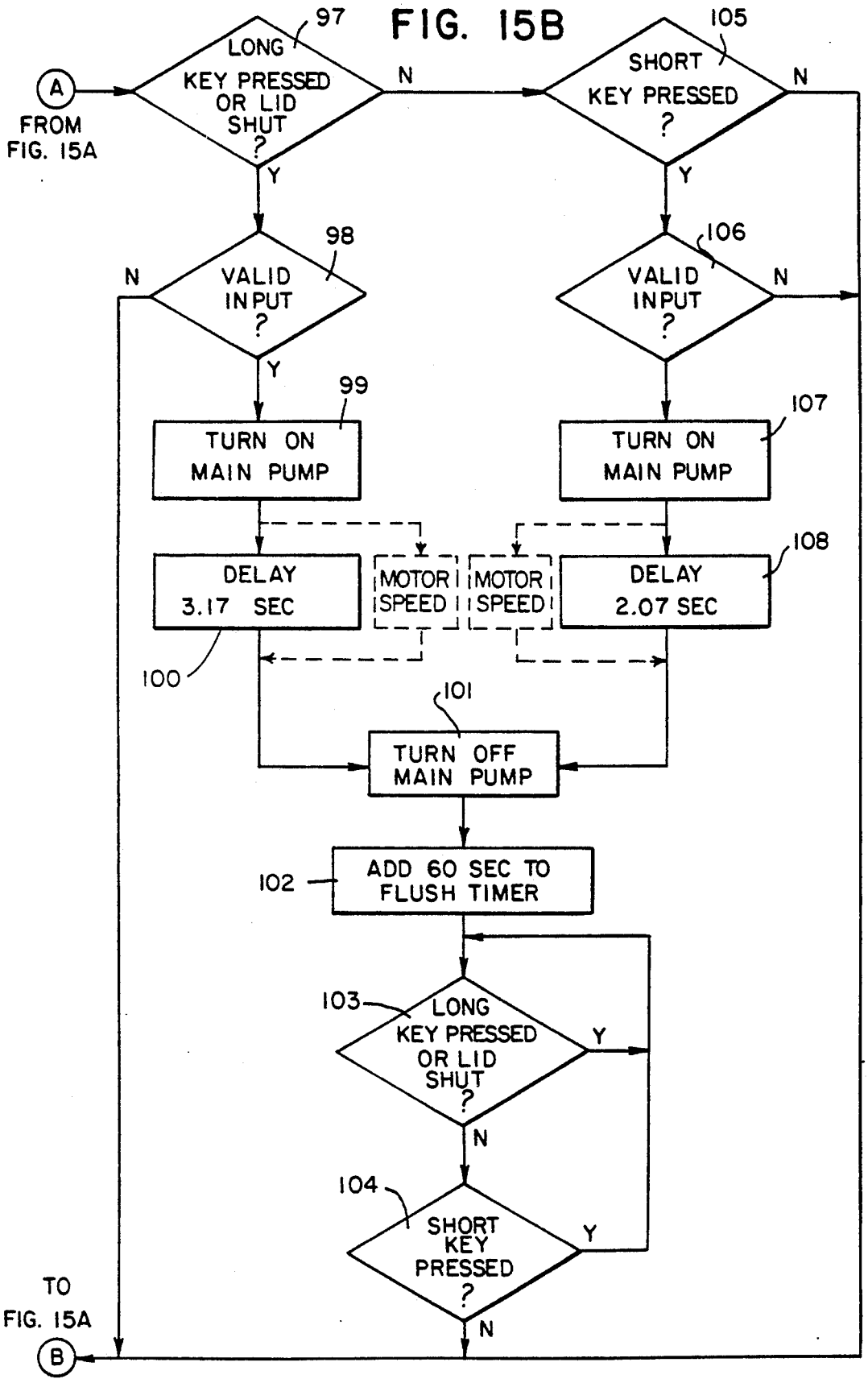

Referring to FIGS. 15A and B, these represent the flow diagram for embodiment shown in FIGS. 1–7. The first step in the operation of the pump toilet 10 after the start 89 is the decision step 90 as to whether a switch has been activated such as by a key or push button. If a key is not activated, a background timer is updated at 91 and at 92. It is checked to see if it has a designated number of units. If it does, it is reset at 93 and a flush timer is looked at at 94 to determine if it equals 0 seconds. If it does not, it is decremented at 95.

This background timer will operate in conjunction with the flush timer in a manner to be explained in conjunction with the actuation of the later described activation of the long and short keys at 97 and 105 and the timing of the main pump 18. At step 96, the flush timer is checked to see if it is at greater than 30 seconds. If it is not, this allows activation of either the long or short keys at 97 or 105.

If it is the long flush key at 97, such as activated by switch 82,, then main pump 18 is turned on at step 99 after a valid input check at 98. This immediately delivers water to the rim portion 14 by way of conduit 30, as well as to the jet in the bowl portion 12 through conduit 25. After a delay of 3.17 seconds as indicated at step 100, the pump 18 is turned off at step 101. This will deliver 1.6 gallons of water and would normally be used to flush fecal matter. At step 102 there is added 60 seconds to the flush timer after which there is a determination made at 103 and 104 as to whether the long or short key has been pressed before another flush cycle is initiated. If instead of the long flush cycle, a shorter one is selected, the short flush key 105 is activated such as by switch 81. After an input check at 106, the pump 18 is activated at 107, and it is operated for 2.07 seconds as indicated at 108. It is turned off at 101 after delivering 1.0 gallon of water. This short flush would normally be used to flush urine and paper. Again 60 seconds would be added to the flush timer as indicated at 102.

The background and flush timers are programmed in conjunction with steps 96 and 102 so that there are two delay features. The first involves a situation where a second flush occurs more than 30 seconds but less than 60 seconds after the first flush. It will be recognized that there is always a 30 second delay between flushes in order to refill the tank 17. In this situation, the toilet may be flushed a second time after the initial 30 second delay, but if this is done, it may then not be flushed a third time until there has been a maximum of 90 seconds from the first flush and add 60 seconds to each flush thereafter. The second alternative involves a situation where the second flush does not occur within 60 seconds of the first flush or 90 seconds after any following flushes. In this case, the background timer automatically resets and the toilet can be flushed again with no limit other than the 30 seconds required to fill the tank. In essence, this means that the toilet may be flushed every 60 seconds without being limited, as in the first case.

Figure 16A:
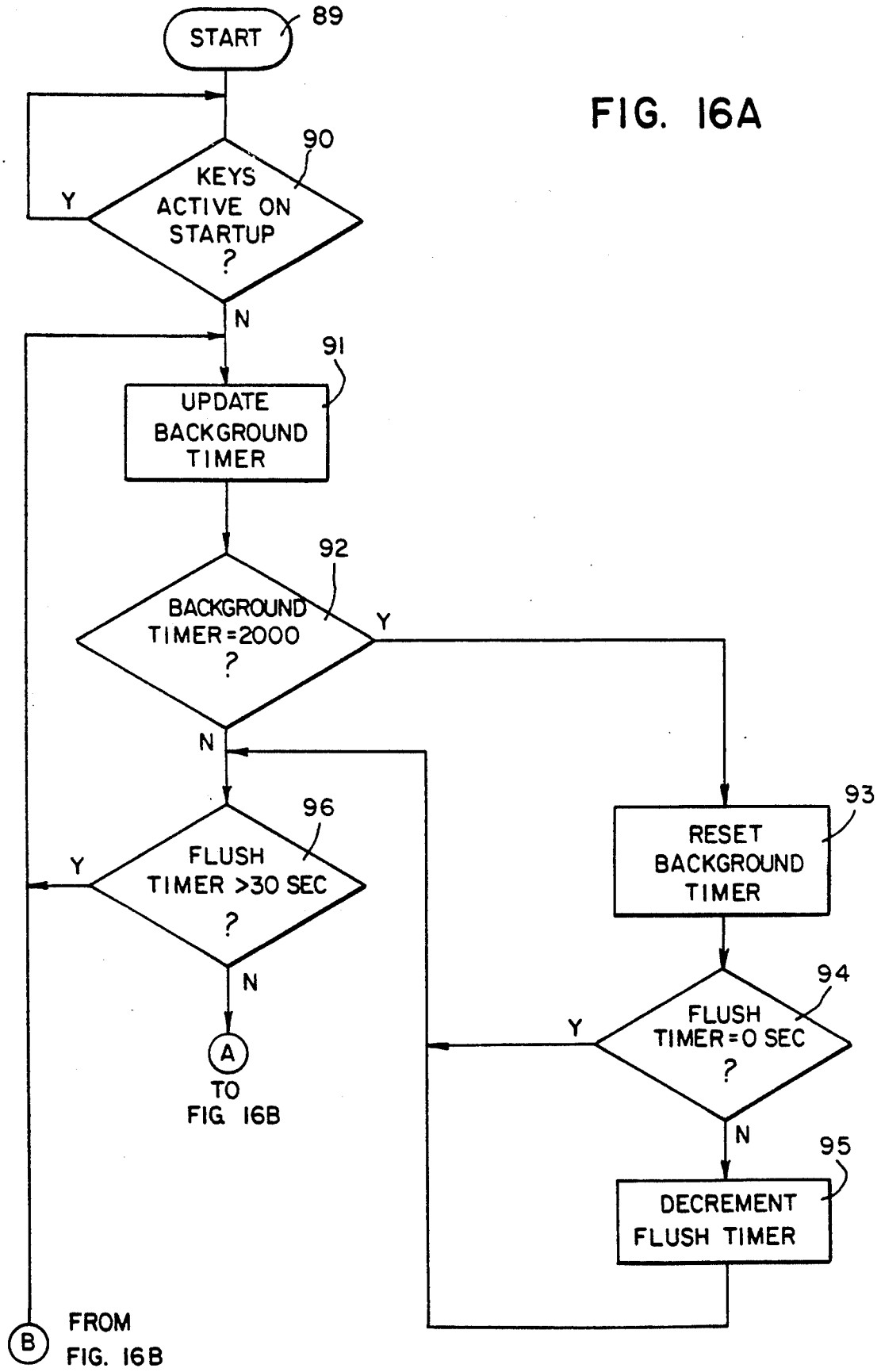
Figure 16B:
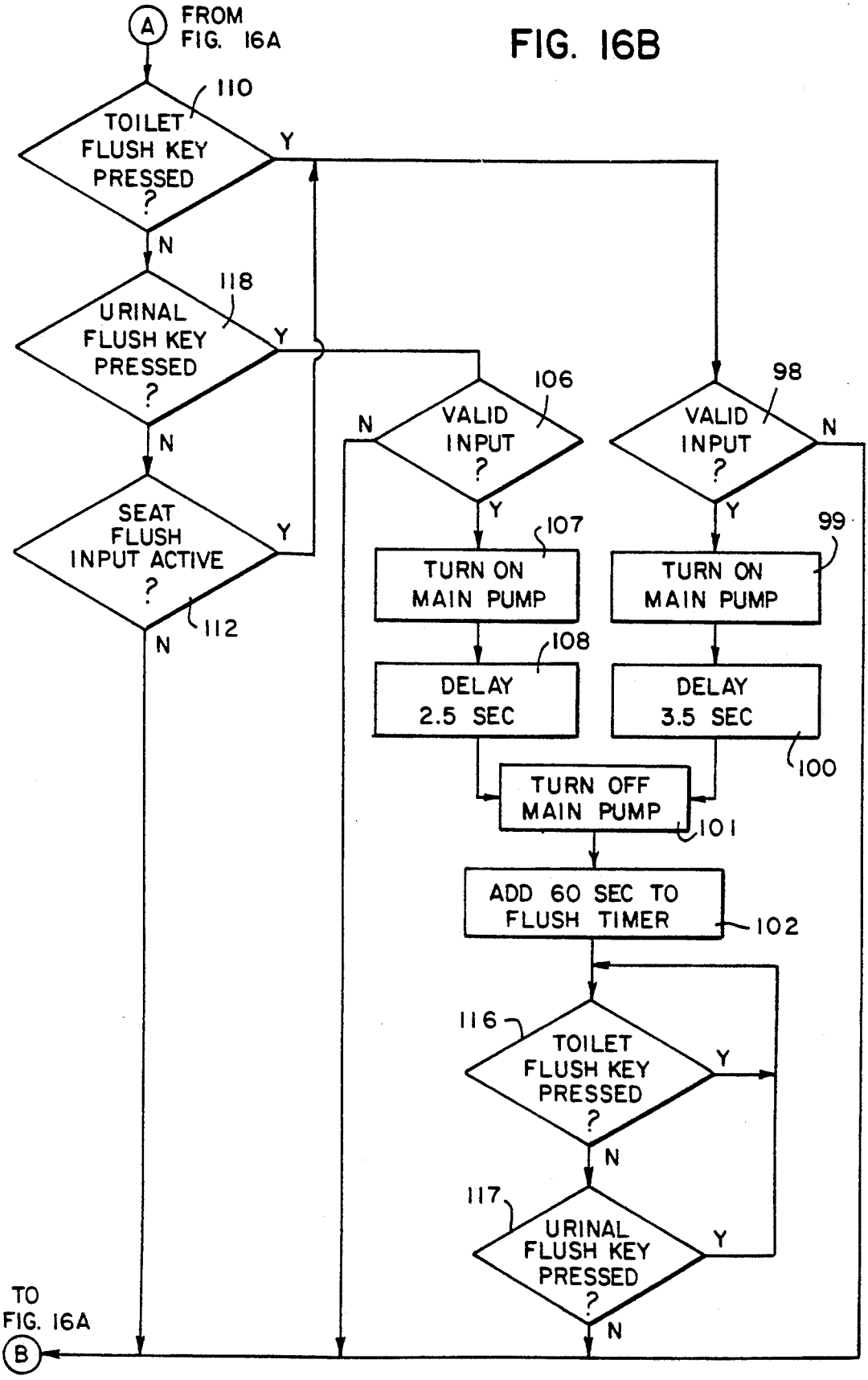

Referring to FIGS. 16A and B, these represent the flow diagram for embodiment shown in FIG. 12. It will be seen that steps 89–96 are the same as previously described in conjunction with FIG. 15A. If the toilet flush key 110 is selected, which would be activated such as by switch 82, then the same steps 98–102 would be followed as previously explained in conjunction with FIG. 15B. Similarly, the same determinations of the status of the toilet and urinal flush keys are made at 116 and 117. In the event the seat flush feature is activated such as at 112 and by the lid closed switch 84, the same procedure will be followed as indicated at steps 98–102 for the long flush. In the instance where the urinal flush key is activated at 118, a short flush cycle is initiated which is similar to steps 106–108 and 101 and 102 as described in conjunction with FIG. 15B.

Figure 17A:
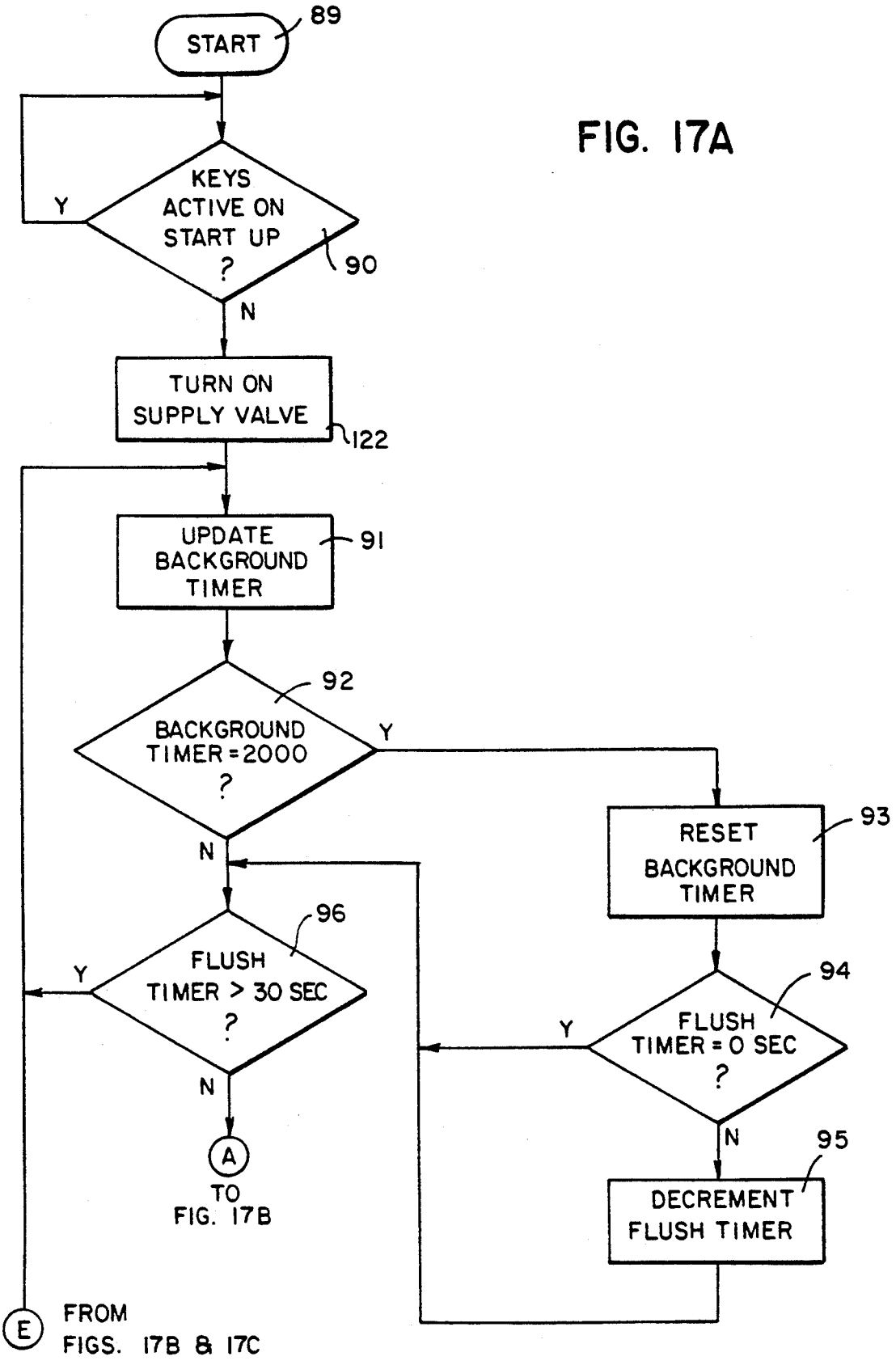

Referring to FIGS. 17A, B and C, these represent the flow diagrams for the embodiment shown in FIGS. 8–10. The steps 89–96 are the same as previously described in conjunction with FIGS. 15A and 16A except for step 122 where supply valve 60 is turned on. If the long flush key 97 is activated, then main pump 18A is turned on at step 99 after a valid input check at 98. This immediately delivers water to the rim portion 14A by way of conduit 30A. Water is prevented from flowing through conduit 27A to the jet in the bowl portion 12A as jet diaphragm valve 62A is closed. After a delay of 0.5 second as indicated at step 123, the solenoid pilot 63A is activated at step 124. This delivers water from pump 18A to flow to the jet in the bowl portion 12A as well as to the rim portion 14A through conduit 30A. After 3.5 seconds as seen at step 100, the valve 62A is closed at step 125. After a delay of 3.0 seconds as indicated at step 126, water continues to flow to the rim portion 14A. After the 3 second delay, the main pump 18A is turned off at step 101. The remaining steps 102–104 are the same as previously described in conjunction with FIG. 15B.

A seat activated function is also shown at step 136 in conjunction with long flush steps 98–101 as previously described.

In the event a shorter flush is desired, such as to flush urine or paper, the short flush button 81 is activated to initiate the short flush as indicated at step 105. The subsequent steps 106–130 are essentially the same as indicated for the respective steps 98–126 except for step 108 where the pump is operated for 2.5 seconds rather than 3.5 seconds.

In addition to the previous flushing functions, there is also an independent cleanser flush indicated at step 131 which delivers a cleaning fluid to the rim portion 14A. After a valid input check at 132, the main pump 18A and the sanitary pump 54A are turned on at step 133. After a time period of 6.0 seconds at step 133, the main pump 18A and the sanitary pump 54A are turned off at step 134 after which there is a delay period of 60 seconds as shown at 135.

Figure 14:
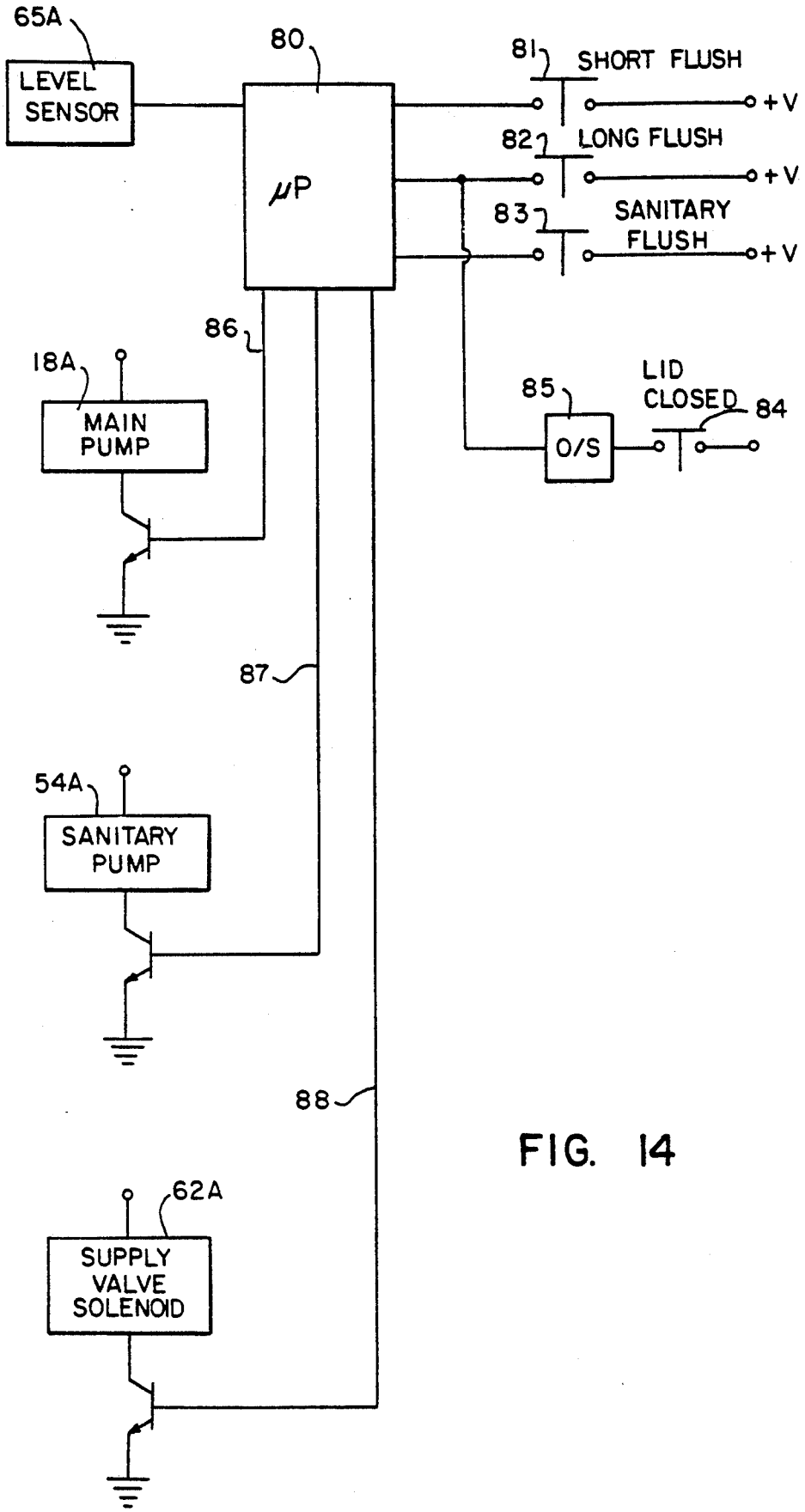
FIG. 14 is a diagrammatic view of a control circuit for the motor and pump.
Figure 17B:
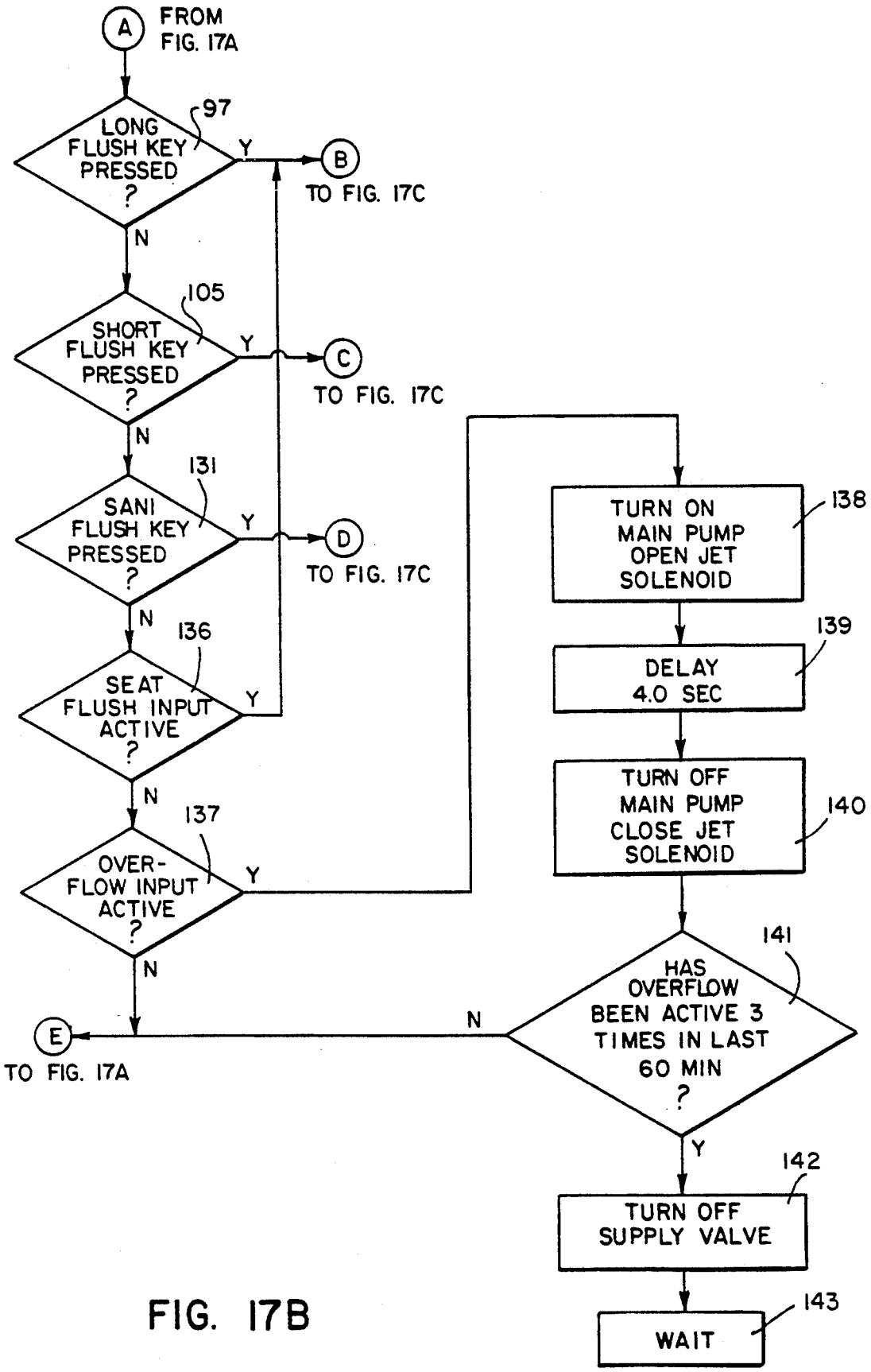
Figure 17C:
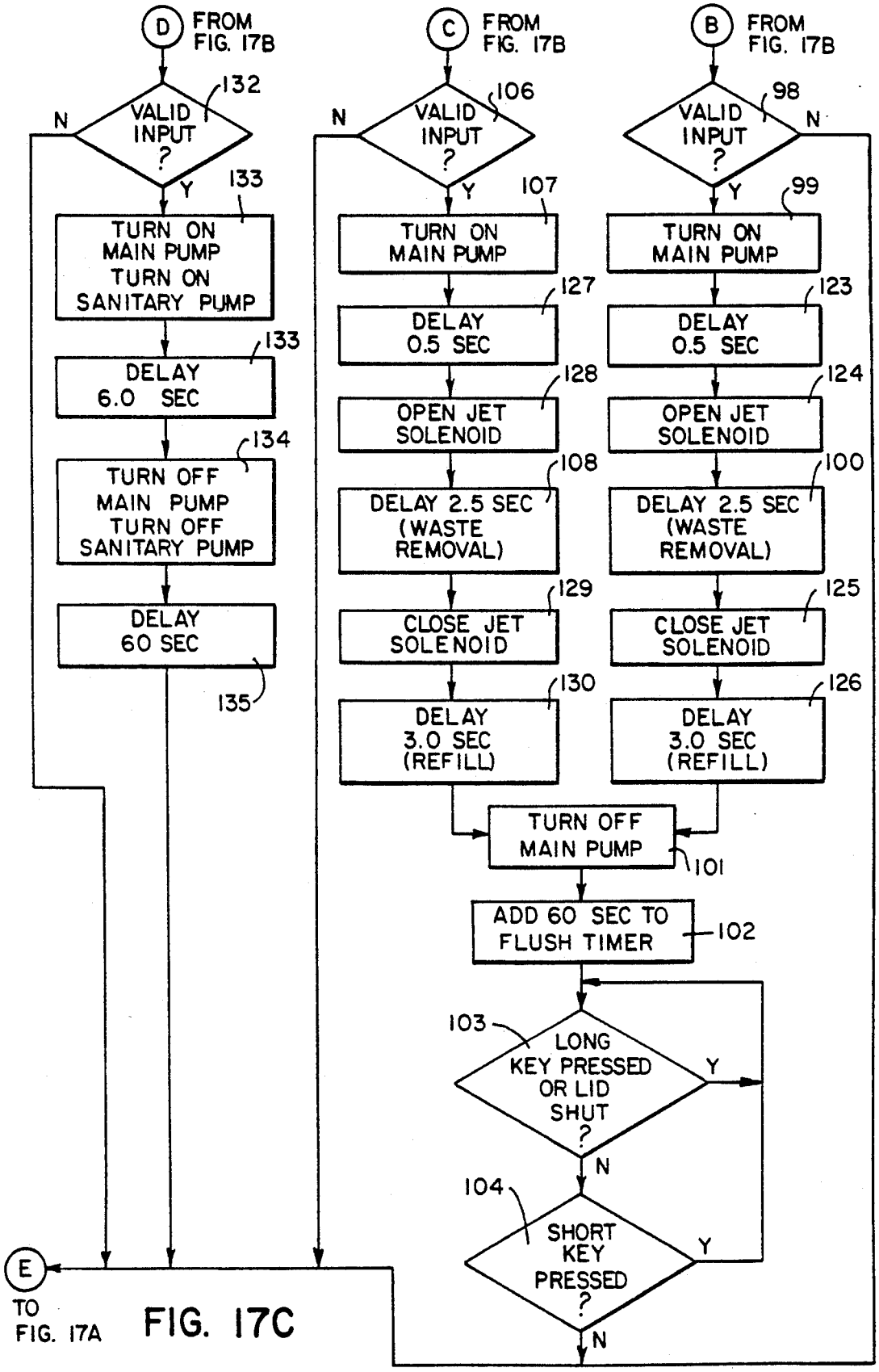

Referring also to FIGS. 14 and 17B, it is seen that a signal is sent to the microprocessor 80 from the level sensor 65A. This signal is shown as activated at 137 with the main pump 18A being turned on at 138 as well as the jet solenoid to pump water from the reservoir 16A and to the toilet 10A in order to prevent an overflow condition in the reservoir 16A should float valve assembly 37A malfunction. After a delay of 4 seconds, the main pump 18A and jet solenoid are turned off at 140. If the overflow feature has been active 3 times in 60 minutes as shown at 141, the supply valve 60A is turned off at 141 and a waiting period initiated at 143. An additional safety feature in conjunction with the microprocessor 80 is the closing of supply valve 60A in the event of electrical failure to the control circuit and pump 18A and the failure of float valve assembly 37A to close.

Thus our invention provides an improved toilet flushing system which utilizes a minimum of water for each function. The need for double flushing is reduced. While preferred embodiments have been described above, it should be readily apparent to those skilled in the art from this disclosure that a number of modifications and changes may be made without departing from the spirit and scope of the invention. For example, while a delivery of flush water to the rim in a first sequence, to the rim and bowl in a second sequence, and to the rim only in a third sequence has been described in conjunction with the pump toilet, this system can be altered to deliver water only to the rim by eliminating the conduits 27, 27A, 27A′ and 27A″ to the bowl as well as the valve 62A. Alternatively, flush water delivery only to the bowl can be effected by the herein described system by elimination of the conduits 30 and 30A to the rim and valve 62A. Any combination of the delivery of flush water to the rim and/or bowl can be effected by suitable valving. For example, if it is desired to have water flow only to the bowl in one sequence with a rim-bowl-rim delivery, a valve such as 62A can be placed in conduit 30A. Alternatively, a 3-way valve could be used in conjunction with conduits 27, 27A, 27A′, 27A″ and 30A.

A long and short flush cycle have been described in conjunction with the previously disclosed embodiments. It should be understood that these two cycles can be employed independently of the bowl cleaner flush or the seat cover activation. In the same manner, a third longer flush cycle could be utilized with the long and short flush cycle as well as an intermediate one with varying quantities of flush water. Similarly, if desired, only a single flush cycle could be employed by eliminating one of the flush cycles and still operate the pump for a period of time to deliver a quantity of water from the reservoir tank to the toilet bowl. While the reservoir 16B and pump 18B have been described in conjunction with one toilet 10B and one urinal 74B, a multiplicity of these plumbing fixtures could be employed by interconnection with output conduits 73B and 74B. All of the flush cycles previously described in conjunction with embodiment 10A can be utilized with toilet 10B.

Further, the seat cover and sanitation functions could be eliminated and still accomplish the water saving feature. Similarly, the overflow features could be eliminated and still accomplish the described water saver functions. Also, the cleanser function could be automated such that the processor would count uses such that after a given number of uses of a toilet (e.g. thirty), the cleaning cycle would automatically occur. A long and short flush cycle have been effected by operating a pump motor for different time intervals. This could also be accomplished by running the pump motor at two different speeds as shown alternatively in dotted line in FIG. 15B. All such and other modifications within the spirit of the invention are meant to be within the scope of the invention.

We claim:

1. A plumbing fixture for receiving flushable waste comprising:

at least one receptacle for receiving said waste;

a reservoir tank for storing a volume of flush water;

a pump motor and pump both positioned in the reservoir tank, an inlet of the pump being in communication with the interior of the reservoir tank;

a conduit connected between an outlet of the pump and the receptacle; and control means selectively and operatively connected to the motor to operate the pump for a period of time to deliver a quantity of flush water to the pump outlet.

2. The plumbing fixture as defined in claim 1, wherein:

the receptacle is a toilet bowl having a hollow rim and a basin and the conduit is connected to the basin below the rim; and there is an additional conduit connecting the pump outlet with the rim.

3. The plumbing fixture as defined in claim 1, wherein the motor has at least two different speeds.

4. The plumbing fixture as defined in claim 1, wherein the pump is operated by a magnetically driven drive shaft driven by the motor.

5. The plumbing fixture as defined in claim 1, further including a sensing means to determine the level of flush water in the reservoir tank and the control means includes counting means to ascertain the number of times the sensing means is activated, the control means being constructed to close a supply valve for controlling flush water to the reservoir tank when the counting means reaches a predetermined number.

6. The plumbing fixture as defined in claim 1, wherein the control means is activated by switches of the touch type.

7. A plumbing fixture for receiving flushable waste comprising:

at least one receptacle for receiving said waste;

a reservoir tank for storing a volume of flush water;

pump means in fluid communication with the interior of the reservoir tank, the pump means including a pump and a pump motor both positioned in the reservoir tank;

a conduit connected between an outlet of the pump means and the receptacle; and control means selectively and operatively connected to the pump means to operate the pump means for one period of time to deliver one quantity of flush water to the receptacle and in the alternative to operate the pump for at least one other period of time to deliver at least one other quantity of flush water to the receptacle.

8. The plumbing fixture as defined in claim 7, wherein the receptacle is a toilet bowl.

9. The plumbing fixture as defined in claim 8, wherein the toilet bowl has a hollow rim and the conduit is connected between the pump outlet and the rim.

10. The plumbing fixture as defined in claim 9, wherein there is an additional conduit connecting the pump outlet with a basin part of the toilet bowl.

11. The plumbing fixture as defined in claim 10, wherein the control means is further selectively and operatively connected to the pump means to sequentially deliver a volume of flush water to the rim in a first sequence, a volume of flush water to both the toilet bowl basin and the rim in a second sequence, and a volume of flush water to the rim in a third sequence.

12. The plumbing fixture as defined in claim 10, wherein the control means is further selectively and operatively connected to the pump means to simultaneously deliver a volume of flush water to both the rim and the basin.

13. The plumbing fixture as defined in claim 10, wherein the control means is further selectively and operatively connected to the pump means to deliver a volume of flush water only to the rim.

14. The plumbing fixture as defined in claim 10, wherein the control means is further selectively and operatively connected to the pump means to sequentially deliver a volume of flush water to the rim in a first sequence and a volume of flush water to both the rim and the toilet bowl basin in a second sequence.

15. The plumbing fixture as defined in claim 14, wherein the fixture further comprises valve means for delivering water to the rim independently of the pump means after the delivery of flush water to the rim and the toilet bowl basin.

16. The plumbing fixture as defined in claim 10, wherein the control means is further selectively and operatively connected to the pump means to sequentially deliver a volume of flush water to the rim in a first sequence, a volume of flush water to the toilet bowl in a second sequence, and a volume of flush water to the rim in a third sequence.

17. The plumbing fixture as defined in claim 7, wherein the control means provides preselected periods of time to operate the pump means to pump the one quantity of the flush water and other quantity of flush water at different quantities from the reservoir tank to the receptacle.

18. The plumbing fixture as defined in claim 7, wherein the control means includes a time delay means for preventing activation of the pump before a specified delay after the last activation of the pump.

19. A toilet comprising:

a toilet bowl having an upper periphery defining a top;

a reservoir tank for storing a volume of flush water;

pump means in fluid communication with the reservoir tank;

a first conduit connected between an outlet of the pump means and the toilet bowl;

control means selectively and operatively connected to the pump means to operate the pump means for a period of time to deliver a quantity of flush water to the pump outlet;

an intake conduit for the tank adapted to be connected to a source of water;

a refill control valve operatively connected to the intake conduit; and a tube connected between the refill control valve and the toilet bowl;

whereby water will flow through the tube to the bowl to establish a water seal in the toilet independently of the water delivered by the first conduit and the pump means.

20. The toilet as defined in claim 19, wherein the refill control valve is constructed and arranged so that after water is pumped through the first conduit and pump operation ceases, additional water will flow through the tube to the bowl to establish a water seal.

21. The toilet as defined in claim 19, wherein the pump means includes a pump motor and pump positioned in the reservoir tank.

22. A toilet comprising:

a toilet bowl having an upper periphery defining a top;

a reservoir tank for storing a volume of flush water;

pump means in fluid communication with the reservoir tank;

a conduit connected between an outlet of the pump means and the toilet bowl;

control means selectively and operatively connected to the pump means to operate the pump means for a period of time to deliver a quantity of flush water to the pump outlet; and fluid return passage means interconnecting the tank and the toilet bowl to permit the back flow of water from the toilet bowl to the tank;

whereby spillage of water over the top due to operation of the toilet is inhibited by the fluid return passage means.

23. The toilet as defined in claim 22, wherein the control means includes a time delay means to prevent activation of the pump means for a given period of time.

24. The toilet as defined in claim 22, wherein the pump means includes a pump motor and pump positioned in the reservoir tank.

25. A toilet comprising:

a toilet bowl having an upper periphery defining a top;

a reservoir tank for storing a volume of flush water;

pump means in fluid communication with the reservoir tank;

a conduit connected between an outlet of the pump means and the toilet bowl;

control means selectively and operatively connected to the pump means to operate the pump means for a period of time to deliver a quantity of flush water to the pump outlet;

the pump means including a pump motor being positioned in the tank; and fluid passage means for providing fluid communication between the tank and toilet bowl and being positioned below a point where water could enter the motor.

26. The toilet as defined in claim 25, wherein the pump means further includes a pump positioned with the pump motor in the reservoir tank.

* * * * *

UNITED STATES PATENT AND TRADEMARK OFFICE

CERTIFICATE OF CORRECTION

PATENT NO. : 5,305,475

DATED : April 26, 1994

INVENTOR(S) : Norman J. Jaeckels et al.

It is certified that error appears in the above-identified patent and that said Letters Patent is hereby corrected as shown below:

| | |
|---|---|
| Title Page [75 Inventors] | line 2, after "Norman J. Jaeckels, Sheboygan" "John A. Fiumefreddo, Plymouth," should be deleted. |
| Column 6, line 32 | after "82," the second "," should be deleted. |

Signed and Sealed this

Twenty-fifth Day of October, 1994

*Attest:*

*Attesting Officer*

Bruce Lehman

BRUCE LEHMAN

*Commissioner of Patents and Trademarks*